US007340792B2

(12) United States Patent
Czyzewski et al.

(10) Patent No.: US 7,340,792 B2
(45) Date of Patent: Mar. 11, 2008

(54) PROCESS FOR ELIMINATING FOAM IN THE LYE CONTAINER OF A DRUM WASHING MACHINE

(75) Inventors: Gundula Czyzewski, Berlin (DE); Ingo Schulze, Panketal (DE)

(73) Assignee: BSH Bosch und Siemens Haugeraete GmbH, Munich (DE)

( * ) Notice: Subject to any disclaimer, the term of this patent is extended or adjusted under 35 U.S.C. 154(b) by 289 days.

(21) Appl. No.: 11/045,529

(22) Filed: Jan. 28, 2005

(65) Prior Publication Data

US 2005/0197264 A1 Sep. 8, 2005

Related U.S. Application Data

(63) Continuation of application No. PCT/EP03/06861, filed on Jun. 27, 2003.

(30) Foreign Application Priority Data

Jul. 29, 2002 (DE) ..... 102 34 472

(51) Int. Cl.

| | |
|---|---|
| ***D06B 35/00*** | (2006.01) |
| ***D06M 11/38*** | (2006.01) |
| ***B08B 3/12*** | (2006.01) |
| ***D06F 37/00*** | (2006.01) |
| ***D06F 29/00*** | (2006.01) |
| ***D06F 35/00*** | (2006.01) |
| ***D06F 13/02*** | (2006.01) |
| ***D06F 39/00*** | (2006.01) |

(52) U.S. Cl. ..... 8/158; 8/127; 8/159; 68/3 R; 68/17 R; 68/12.12; 68/12.21; 68/137; 68/207; 68/213

(58) Field of Classification Search ..... 8/158, 8/127; 68/137, 3 R, 17 R, 12.12, 12.21, 68/207, 213

See application file for complete search history.

(56) References Cited

U.S. PATENT DOCUMENTS 3,699,431 A 10/1972 Paddison et al.

(Continued)

FOREIGN PATENT DOCUMENTS

DE 6919393 10/1970

(Continued)

OTHER PUBLICATIONS

International Search Report for PCT/EP2003/006861.

*Primary Examiner*—Michael Barr
*Assistant Examiner*—Rita R Patel
(74) *Attorney, Agent, or Firm*—Russell W. Warnock; James E. Howard

(57) ABSTRACT

A sensor for determining the level of the liquid in the lye container for removing foam in the lye container of a drum washing machine with a lye discharge system arranged on the floor of the lye container with a lye pump during a program step, which is provided for dehydrating the lye container. Its sensor signal P is recorded during operation of the lye pump. According to the present invention the sequence p/t of the sensor signal contains a component $\Delta p/\Delta t$, whereof the presence indicates the presence of foam in the measuring region. Further, in the presence of the component a foam treatment measure suiting the type of component is introduced.

11 Claims, 2 Drawing Sheets

U.S. PATENT DOCUMENTS

| | | | | |
|---|---|---|---|---|
| 5,165,260 | A * | 11/1992 | Geiger | 68/12.04 |
| 5,647,232 | A | 7/1997 | Boldt et al. | |
| 5,890,247 | A | 4/1999 | Erickson et al. | |
| 6,032,494 | A | 3/2000 | Tanigawa et al. | |
| 6,378,341 | B1 * | 4/2002 | Wiemer et al. | 68/12.02 |
| 6,405,580 | B2 * | 6/2002 | Kirts et al. | 73/60.11 |
| 6,561,200 | B1 * | 5/2003 | Fournel et al. | 134/22.19 |

FOREIGN PATENT DOCUMENTS

| | | |
|---|---|---|
| DE | 1 760 809 | 1/1972 |
| DE | 2 325 586 | 12/1974 |
| DE | 41 04 151 A1 | 8/1992 |
| EP | 0 268 155 A2 | 5/1988 |
| EP | 0 278 239 A1 | 5/1991 |
| EP | 0 984 092 A1 | 3/2000 |
| EP | 0 992 622 A2 | 4/2000 |
| GB | 982310 | 2/1965 |

* cited by examiner

PROCESS FOR ELIMINATING FOAM IN THE LYE CONTAINER OF A DRUM WASHING MACHINE

The invention relates to a process for removing foam in a lye container of an electronically controlled drum washing machine as a result of a program step, provided for dehydrating the lye container, with a lye discharge system arranged on the floor of the lye container with a lye pump and with a sensor for determining the level of the liquid in the lye container, whereof the sensor signal is recorded during operation of the lye pump.

Such a process is known from DE 198 46 248 A1. Therein foam is recognised in the discharge system during operation of the lye pump by a sensor on the basis of an optoelectronic sensor. By means of measures (not illustrated in greater detail) this foam can be broken up. This foam recognition method is secure to some extent, though it requires a particular optosensor, which is not always available due to its other duties.

A similar process is known from EP 0 278 239 A1. In this, removing excessive foam buildup in the main wash cycle, observed during heating of washing lye in the lye container, is eliminated by addition of a limited quantity of cold water and/or by temporarily switching off the lye heating.

The aim of the invention is to provide measures for removing foam in the discharge system, which occurs especially during discharge of the lye from the lye container and above all during pumping or respectively during spinning of the washing drum. These measures should above all require no additional expenditure.

According to the present invention this task is solved in that the sequence of the sensor signal contains a component, which detects the presence of foam in the measuring region, and in that in the presence of the component a foam treatment measure suiting the type of component is introduced. Since a level sensor must be available for ascertaining the level of the liquid in the lye container, no additional expenditure on measuring means is required. Detecting the components, whereof the presence hints at the presence of foam, can be realised with minimal expense for software in the electronic controls of the washing machine.

In a particularly advantageous further development of the invention the component is a specific change of the gradient of the sensor signal. It has surprisingly been shown that the sequence of the sensor signal of a level indicator contains a component, which indicates the presence of foam. This component can be derived by the gradient of the level fluctuation variables, observed the washing lye is pumped out prior to commencement of a spin cycle.

The foam treatment measure can, according to an advantageous further development of the invention, comprise a specific quantity of cold and/or warm water in the supply. This measure is already known per se, but has a particular quality in context with the abovementioned characteristics of the invention, because the task of the just-finished process is to remove liquid. Accordingly, the measuring of water supply in such a process is rather unusual.

Alternatively or in addition to this the foam treatment measure in a further advantageous configuration of the invention can consist of a change in the speed of the washing drum. It has been shown that contrary to previous assumptions that the drum movement is the fundamental cause for the buildup of foam, specific movements of the drum or respectively—according to further advantageous designs of the invention—a particular speed profile or the reversal of the washing drum during application of a foam removal measure in a manner suiting the measured variable of the component in the sense of more efficient foam removal are an advantage.

By way of advantage and alternatively the temperature of the liquid in the lye container can be raised or lowered additionally or during application of the foam removal measure.

One particular measure, which should first be applied if all other measures achieve no adequate effect, could be to add in a substance to inhibit the foam automatically during application of the foam removal measure.

However, the necessary expense would be justified only if devices for automatic metering of washing agents are present anyway in a washing machine.

A pressure transducer present in most washing machines anyway can be used advantageously as level indicator. The inventive process is explained further by means of two diagrams, in which.

DETAILED DESCRIPTION

Figure 3:
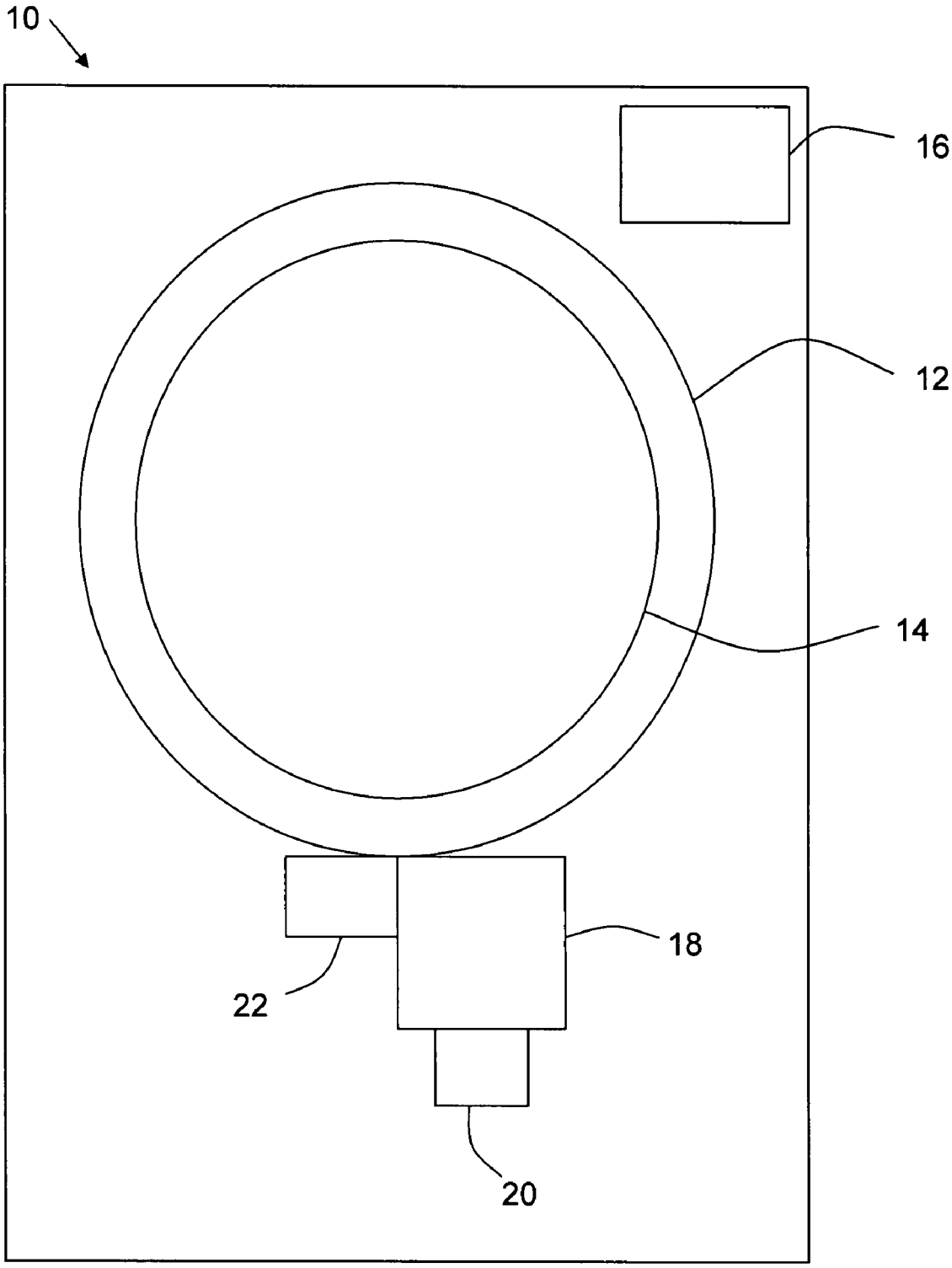
FIG. 3 shows a washing machine embodying aspects of the invention.

FIG. 3 illustrates a washing machine 10 including a lye container 12, an electronically controlled drum 14, and an electronic controller 16. A lye discharge system 18 is arranged on the floor of the lye container 12 with a lye pump 20 and with a sensor 22 for determining the level of the liquid in the lye container 12.

Figure 1:
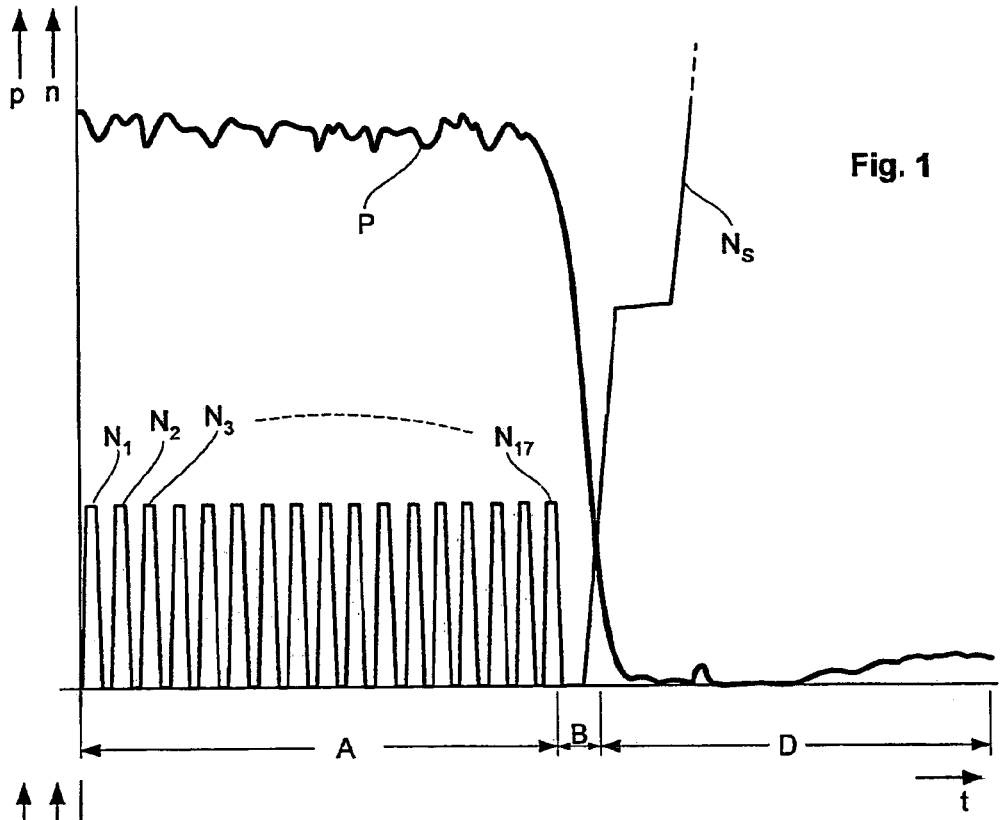
FIG. 1 shows via a diagram the pressure march p/t during drum rotation n/t and during pumping out without disturbing foam in the lye container.

The diagram of FIG. 1 shows a section A, the loosening phase, prior to the spin cycle. During the loosening phase the washing drum is powered with washing speed intermittently. This can occur in alternating directions. The speed peaks $N_1$ to $N_{17}$ indicated in thin lines represent the intermittent drive of the washing drum. During this phase the fluctuations in level (thick line P) of the liquid in the lye container are comparatively small. On completion of the loosening phase A the liquid is pumped out of the lye container, so that the thick line P falls away very steeply almost constantly to almost to zero. The speed of the washing drum rises after setting the constant level fall rate in section B to a preselected spin speed $N_s$. This means that a greater quantity liquid per time unit is spun out of the laundry than the pump can momentarily cope with. As a result the level of the liquid in the lye container in the section D again rises slightly, until the spun-out quantity of liquid per time unit becomes less than the pump rating.

Figure 2:
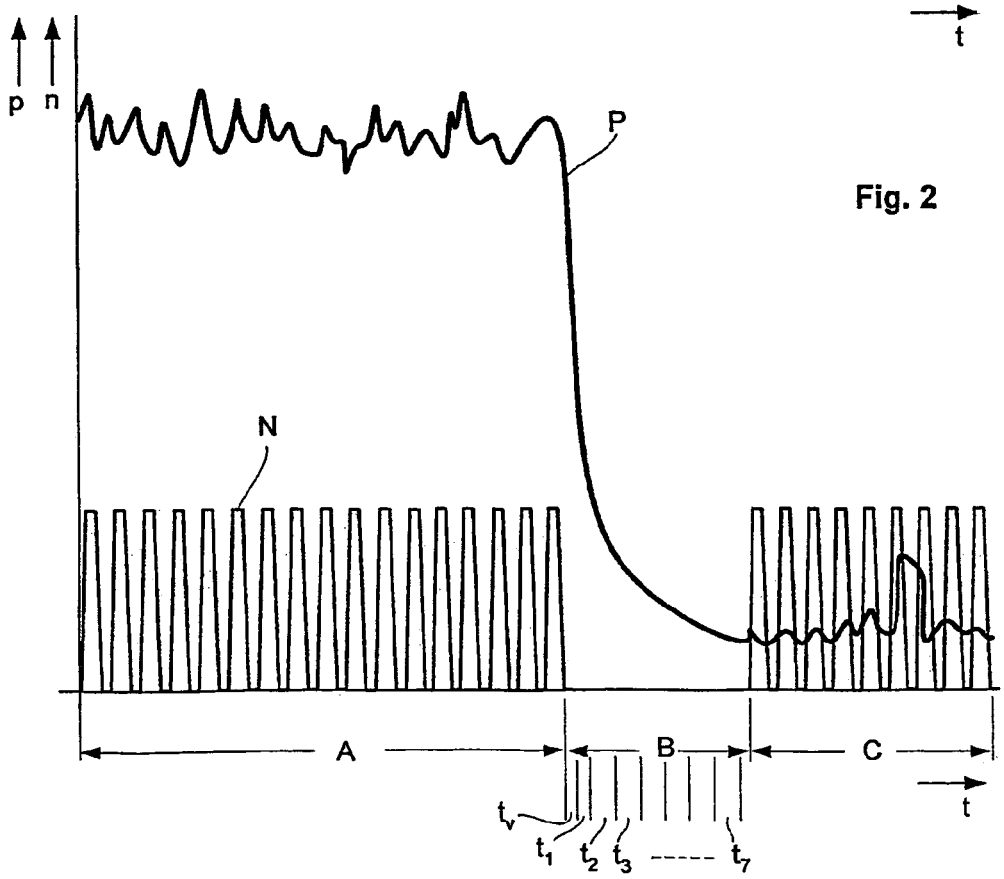
FIG. 2 shows via a further diagram the pressure march p/t in the lye container during drum rotation n/t and during pumping out with disturbing foam in the lye container.

The diagram of FIG. 2 by comparison shows, apart from somewhat stronger fluctuations in pressure already in section A, a sharper change in the level progress P during sections B lasting much longer than in FIG. 1, which is provided for accelerating the drum to the spin speed. Yet this simply does not happen, because the minimal falloff of the pressure curve P signals a considerable quantity of foam and first one of the above foaming measures, not illustrated in greater detail, must be introduced, so that the foam collapses and cannot hinder the rapid drum movement. In section C therefore the drum is first moved intermittently, in order to check whether the foaming measure has taken hold. After more idling of the drum and pumping out of the remaining quantity there should be a pressure falloff curve, as there is at the end of section B in FIG. 1. After this—as in section D of FIG. 1—the drum can be accelerated to spin speed.

The pumping out behaviour in FIG. 2 clearly differs from that in FIG. 1 (without harmful foam). It begins normally with a slight offset (time interval $t_v$), which lasts for example 2 s and identifies that the pump is starting up securely. Then the pressure march falls rapidly and constantly as in FIG. 1 (time interval $t_1$). This shows how the foam-free lye is pumped out.

But later (time interval $t_2$ to $t_7$) the pumping out speed gradually slows, since the proportion of foam now in the lye increases very rapidly, or respectively the only foam present is what can no longer be discharged by the pump. Successive level gradients, e.g. of $\Delta p_1/\Delta t_1$ to $\Delta p_2/\Delta t_2$ or $\Delta p_6/\Delta t_6$ to $\Delta p_7/\Delta t_7$, accordingly become less and less. From this the electronic controls of the washing machine (not shown here) can recognise the presence of foam. After automatic detection of damaging foam at least a part of the above removal measures can be triggered by the electronic controls, which do not need to be detailed further here.

The invention claimed is:

1. A process for detecting and removing foam in a lye container of a washing machine having an electronically controlled rotating drum, the process comprising the following acts:

providing a lye discharge system having a pump fluidly connected to the lye container;

providing a pressure sensor for sensing a pressure within the lye container, the sensor providing a sensor signal;

removing liquid from the lye container with the lye discharge system;

recording the sensor signal with respect to time to generate a sequence of the sensor signal;

calculating a signal gradient representing the change in the sensor signal with respect to change in time;

comparing successive signal gradients over time;

determining if the successive signal gradients contain a component indicating the presence of foam in the lye container; and performing a foam treatment measure in response to the presence of the component, the foam treatment measure corresponding to the component.

2. The process as claimed in claim 1, wherein the act of performing the foam treatment measure includes supplying a quantity of water into the lye container.

3. The process as claimed in claim 1, wherein the act of performing the foam treatment measure includes rotating the drum and changing the rotational speed of the drum.

4. The process as claimed in claim 3, further comprising providing a particular speed profile for the drum for the foam removal process.

5. The process as claimed in claim 3, further comprising reversing the rotational direction of the drum.

6. The process as claimed in claim 1, wherein the act of performing the foam treatment measure includes raising the temperature of the liquid in the lye container while performing the foam removal measure.

7. A washing machine comprising:

a housing;

an electrically controlled drum being supported for rotation with respect to the housing;

a lye container disposed within the housing and retaining liquids;

a pump for discharging liquid from the lye container;

a pressure sensor sensing pressure within the lye container and providing a sensor signal; and an electronic controller controlling the drum and receiving the sensor signal, the controller calculating a signal gradient representing the change in the sensor signal with respect to change in time and comparing successive signal gradients over time to determine if the successive signal gradients contain a component indicating the presence of foam in the lye container, the controller initiating a foam treatment measure in response to the component.

8. The washing machine of claim 7, wherein the foam treatment measure includes supplying a quantity of water into the lye container.

9. The washing machine of claim 7, wherein the foam treatment measure includes rotating the drum and changing at least one of the rotational speed and the rotational direction of the drum.

10. The washing machine of claim 7, wherein the foam treatment measure includes changing the temperature of the liquid in the lye container while performing the foam removal measure.

11. The process as claimed in claim 7, wherein the foam treatment measure includes adding a foam inhibiting substance to the lye container.

* * * * *